US007183933B2

(12) United States Patent
Dzurko et al.

(10) Patent No.: US 7,183,933 B2
(45) Date of Patent: Feb. 27, 2007

(54) GARAGE CARBON MONOXIDE DETECTOR WITH AUTOMATIC GARAGE DOOR OPENING COMMAND

(75) Inventors: Thomas A Dzurko, Strongsville, OH (US); Lulzim Osmani, Glen Ellyn, IL (US); Edward Cogan, Munson, OH (US); James Heidenreich, Rome, OH (US)

(73) Assignee: Northcoast Innovations, Strongsville, OH (US)

( * ) Notice: Subject to any disclaimer, the term of this patent is extended or adjusted under 35 U.S.C. 154(b) by 147 days.

(21) Appl. No.: 11/087,931

(22) Filed: Mar. 23, 2005

(65) Prior Publication Data

US 2005/0212681 A1 Sep. 29, 2005

Related U.S. Application Data

(60) Provisional application No. 60/555,311, filed on Mar. 23, 2004.

(51) Int. Cl.
*G08B 17/10* (2006.01)

(52) U.S. Cl. ..... 340/632; 340/628; 340/545.1; 318/280; 318/466; 49/13; 49/31

(58) Field of Classification Search ..... 340/632
See application file for complete search history.

(56) References Cited

U.S. PATENT DOCUMENTS 4,197,675 A * 4/1980 Kelly ..... 340/634
4,338,526 A 7/1982 Martin et al.
4,360,801 A 11/1982 Duhame
4,464,651 A * 8/1984 Duhame ..... 340/632
4,737,770 A 4/1988 Brunius et al.
4,808,995 A 2/1989 Clark et al.
4,819,551 A 4/1989 Vole
4,847,542 A 7/1989 Clark et al.
4,929,877 A 5/1990 Clark et al.
5,576,739 A 11/1996 Murphy
5,846,127 A 12/1998 Kile
5,929,580 A * 7/1999 Mullet et al. ..... 318/466
6,020,703 A 2/2000 Telmet
6,036,595 A 3/2000 Vole
D431,487 S 10/2000 Rienks
6,184,787 B1 * 2/2001 Morris ..... 340/632
6,469,464 B1 * 10/2002 McCall ..... 318/468

(Continued)

*Primary Examiner*—Daniel Wu
*Assistant Examiner*—Eric M. Blount
(74) *Attorney, Agent, or Firm*—Wegman, Hessler & Vanderburg

(57) ABSTRACT

A garage monitoring system for use with an automatic garage door opening mechanism that includes a carbon monoxide detector configured to sense the presence of carbon monoxide within the garage and generate an audible alarm when carbon monoxide reaches a predetermined level in the garage. A heater is positioned adjacent the carbon monoxide detector for maintaining the carbon monoxide detector above a minimum operational temperature. The garage monitoring system further includes a garage door position sensor for determining the position of the garage door and generating a signal corresponding to the position of the garage door. A monitoring mechanism interfaces with the garage door opening mechanism, the monitoring mechanism including an acoustic detector for sensing audible sounds, including an audible alarm from the carbon monoxide detector, and for generating a signal to the garage door opening mechanism to open the garage door when the carbon monoxide detector generates an alarm and the garage door position sensor indicates that the garage door is not in the open position.

20 Claims, 6 Drawing Sheets

U.S. PATENT DOCUMENTS 6,563,278 B2 5/2003 Roman
6,572,552 B2 6/2003 Fukukita
6,819,252 B2 11/2004 Johnston et al.
6,828,903 B2 12/2004 Watanabe et al.
6,891,480 B2 * 5/2005 Williams et al. ..... 340/693.6
6,989,757 B2 * 1/2006 Geoffrey et al. ..... 340/632
6,989,760 B2 * 1/2006 Dierking et al. ..... 340/686.1
7,005,994 B2 * 2/2006 King ..... 340/628
2004/0107639 A1 * 6/2004 Mullet ..... 49/25
2005/0086366 A1 * 4/2005 Luebke et al. ..... 709/238

* cited by examiner

GARAGE CARBON MONOXIDE DETECTOR WITH AUTOMATIC GARAGE DOOR OPENING COMMAND

REFERENCE TO RELATED APPLICATION

The present application claims priority under 35 U.S.C. § 119(e) to U.S. provisional patent application Ser. No. 60/555,311, entitled "Garage Carbon Monoxide (Co) Detector And Smoke Detector With Automatic Garage Door Opening Command" filed Mar. 23, 2004.

BACKGROUND OF THE INVENTION

1. Field of Invention

This invention relates to a system for monitoring the environment in a garage and more particularly, to a monitoring system that automatically activates a garage door opening system in response to a detection of high levels of carbon monoxide.

2. Description of Related Art

It is well known that internal combustion engines such as those used in automobiles generate carbon monoxide gas. Carbon monoxide gas is poisonous and high levels of this gas can lead to serious injury and even death if consumed by human beings and animals. Accumulation of carbon monoxide can occur in the garage where the automobile is placed. A common practice is to leave the automobile running to warm it up, before removing it from the garage, resulting in accumulation of carbon monoxide. Another danger exists if a driver places the automobile in the garage and leaves engine running, especially after closing the garage door. Several attempts have been made to monitor the presence of this toxic gas and provide audible or visual warning signals when a dangerous level has been reached. However, these warning signals may go unnoticed if the automobile drive falls asleep with the engine running or is otherwise engaged in an activity that makes it so the warning signals cannot be heard or seen.

Most residences are provided with garages which have one or more overhead garage doors which travel on pairs of generally parallel tracks at the sides of the door opening from a closed vertical position to a substantially horizontal open position a short distance below the ceiling of the garage. Although a garage door may be manually opened or closed by the owner, the vast majority are provided with a reversible electric motor for raising and lowering the door. The garage door opener motor is typically actuated by a switch on a wall of the garage or through a remote radio transmitter carried in the vehicle to send a signal from the vehicle to a receiver operatively connected to the motor to open or close the garage door. Thus, the driver is not required to leave the vehicle and manually open or close the garage door.

It would be beneficial to have a toxic gas sensor in combination with an automatic garage door operator, such that the garage door is automatically opened when a dangerous level of toxic gas is detected.

SUMMARY OF INVENTIVE FEATURES

One embodiment of the invention is directed to a garage monitoring system for use with an automatic garage door opening mechanism. The garage monitoring system includes a carbon monoxide detector configured to sense the presence of carbon monoxide within the garage and generate an audible alarm when carbon monoxide reaches a predetermined level in the garage. The garage monitoring system further includes a heater positioned adjacent the carbon monoxide detector for maintaining the carbon monoxide detector above a minimum operational temperature. The garage monitoring system further includes a garage door position sensor for determining the position of the garage door. The garage monitoring system also includes a switched outlet interfacing with the garage door opening mechanism. The garage monitoring system including an acoustic detector for sensing audible sounds, including an audible alarm from the carbon monoxide detector, and for generating a signal to the garage door opening mechanism to open the garage door when the carbon monoxide detector generates an alarm and the garage door position sensor indicates that the garage door is not in the open position.

In another embodiment, the invention is a garage monitoring system for use with an automatic garage door opening mechanism configured to move a garage door between an open and a closed position. The garage monitoring system includes a carbon monoxide detector configured to sense the presence of carbon monoxide within the garage. The garage monitoring system further includes a garage door position sensor comprising an ultrasonic transmitter and an ultrasonic receiver for measuring the distance to an object using ultrasonic waves for determining the position of the garage door. The garage monitoring system further includes a monitoring mechanism interfacing with the garage door opening mechanism, the monitoring system generating a signal to the garage door opening mechanism to open the garage door when the carbon monoxide detector generates an alarm and the garage door position sensor indicates that the garage door is not in an open position.

The invention is also directed to a garage monitoring system for use with an automatic garage door opening mechanism configured to move a garage door between an open and a closed position. The garage monitoring system includes a carbon monoxide detector configured to sense the presence of carbon monoxide within the garage and generate an audible alarm when carbon monoxide reaches a predetermined level in the garage, and a garage door position sensor for determining the position of the garage door. The garage monitoring system also includes a monitoring mechanism interfacing with the garage door opening mechanism, the monitoring system comprising an acoustic microphone for sensing audible sounds, including an audible alarm from the carbon monoxide detector, wherein monitoring mechanism integrates electric signals from the microphone greater than a determined magnitude over a determined time to generate a signal to the garage door opening mechanism to open the garage door when the garage door position sensor indicates that the garage door is not in an open position.

These and other features and advantages of this invention are described in, or are apparent from, the following detailed description of various exemplary embodiments of the systems and methods according to this invention.

BRIEF DESCRIPTION OF THE DRAWINGS

The above mentioned and other features of this invention will become more apparent and the invention itself will be better understood by reference to the following description of embodiments of the invention taken in conjunction with the accompanying drawings, wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
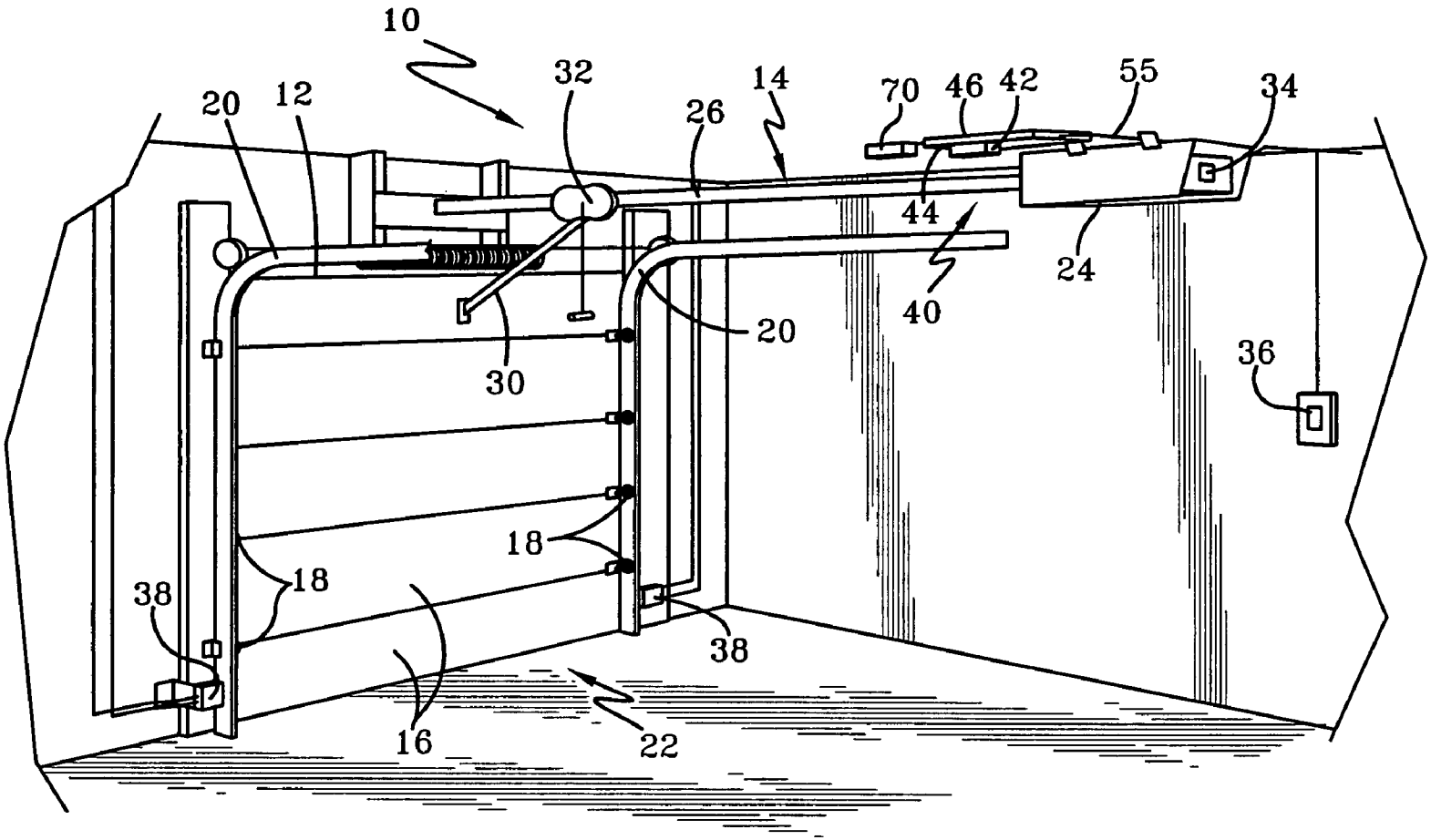
FIG. 1 is a perspective view of a garage door assembly having a garage monitoring system.

Referring more particularly to the drawings wherein is shown an illustrative embodiment of the invention, FIG. 1 discloses a garage door assembly, indicated generally at 10, including a garage door 12 and a garage door opening mechanism 14. The garage door 12 has a plurality of door panel segments 16, each panel segment having one or more pairs of vertically spaced sets of rollers 18 that are guided in a pair of generally parallel tracks 20. The tracks 20 are mounted adjacent an opening 22 and guide the garage door 12 between a shut position and an open position for entry of a vehicle into and from the garage. The garage door opening mechanism 14 includes of a reversible electric motor 24 which drives a garage door opening device 26 such as an elongated screw or a gear that moves a chain to open and shut the garage door 12. A bracket 30 is secured to the garage door 12 and is operationally connected to the opening device 26 by a follower 32.

The garage door opening mechanism 14 includes a receiver 34 that is mounted adjacent and operatively connected to the reversible electric motor 24. The receiver 34 is connected to a wall switch 36 configured to actuate the motor. Additionally, a remote control transmitter (not shown) may be carried in the vehicle to provide a signal to the receiver 34 to open or close the garage door 12 so that the operator of the vehicle can open or close the garage door without leaving the vehicle. Located adjacent the lower ends of the tracks 20 are a pair of photo-eye sensors 38 mounted to project a beam of light across the garage door opening which, when interrupted by an object as the garage door 12 is closing, will reverse movement of the door to its open position. The illustrated garage door assembly 10 described hereto is of conventional design and well known to those in the art, and is provided for illustrative purposes to aid in describing the invention. One skilled in the art will appreciate that the invention may be used with other garage door assemblies without departing from the scope of the invention.

According to the invention, the garage door assembly 10 further includes a garage monitoring system 40 that interfaces with the garage door opening mechanism 14. The garage monitoring system 40 comprises a carbon monoxide (CO) detector 42 and a monitoring mechanism 44. The garage monitoring system 40 is configured to generate an actuating signal to cause the garage door opening mechanism 14 to automatically open the garage door 12 when the presence of carbon monoxide above a predetermined threshold is detected within the garage by the CO detector 42. As described herein, the CO detector 42 is a carbon monoxide detector, but it is understood that the invention can also be used with sensors of other noxious or toxic gases without departing from the scope of the invention. Additionally, the invention is described as being used in a residential garage, but it is understood that the invention can beneficially be used in other spaces, such as auto repair facilities, workshops, furnace rooms, and the like where there is a danger of accumulating high levels of carbon monoxide or other gases that could be mitigated by opening a door or other access flap to ventilate the space without departing from the scope of the invention.

Figure 2:
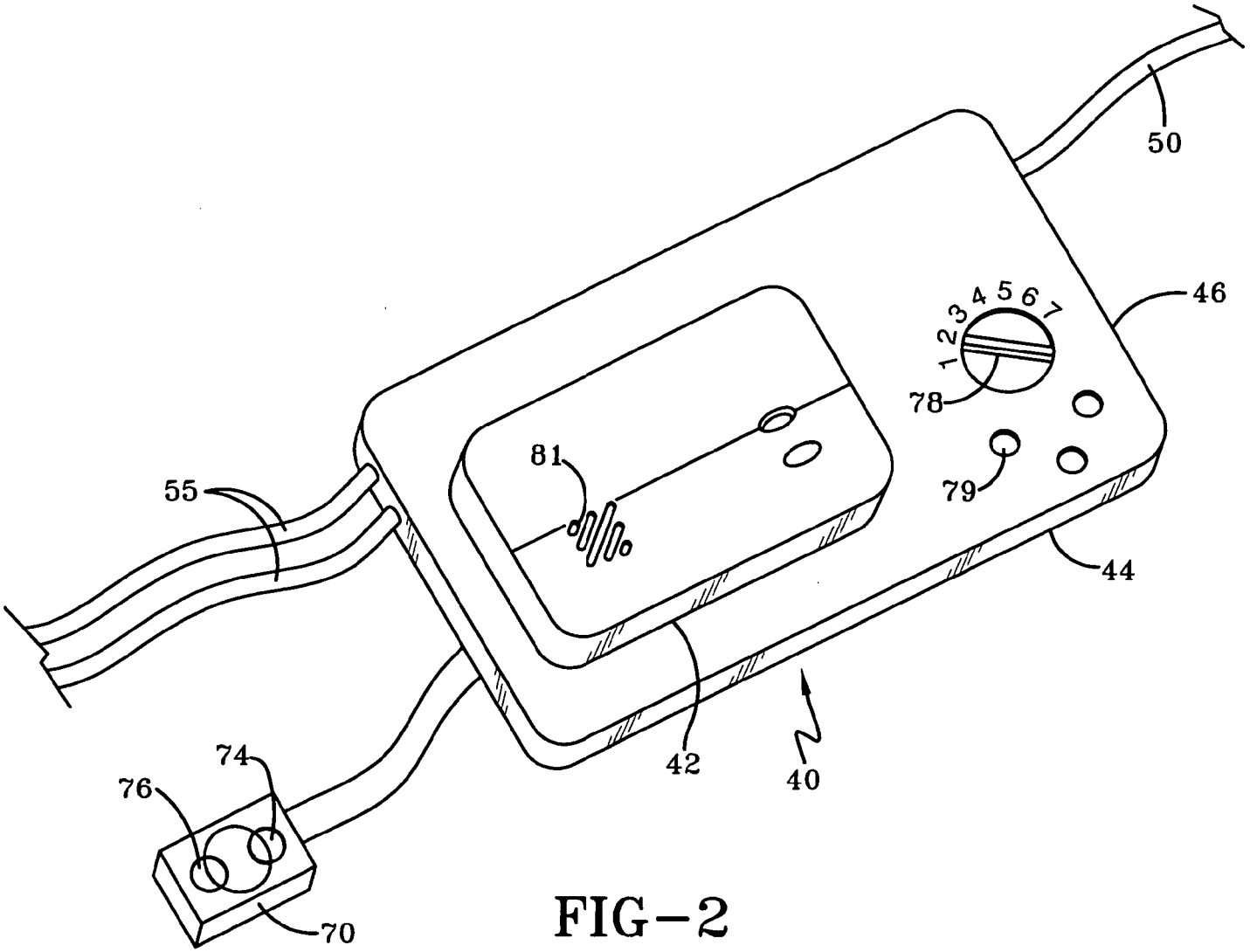
FIG. 2 is a perspective view of the garage monitoring system of FIG. 1.
Figure 3A:
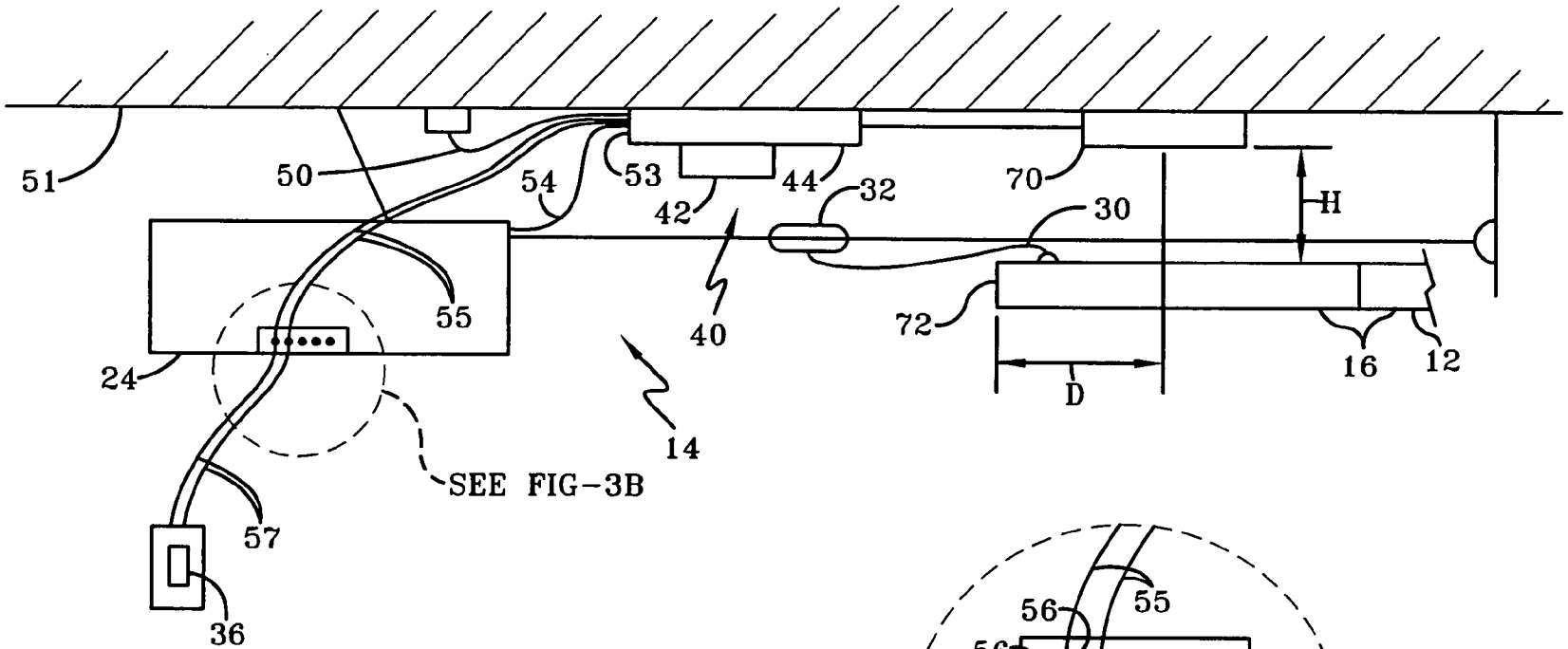
FIG. 3A is a side view of a portion of the garage door assembly and the garage monitoring system of FIG. 1.

As best seen in the embodiment depicted in FIGS. 2 and 3, the garage monitoring system 40 includes a casing 46 that houses the monitoring mechanism 44. The monitoring mechanism 44 includes an electrical plug 50 extending from the casing 46 which may include an electrical connector connectable to the electrical wiring of a conventional AC power supply grid that is commonly used in the house, i.e., a wall outlet supplying 120 volts AC. Desirably, the garage monitoring system 40 is attached to the ceiling 51 (FIG. 3) of the garage near the garage door opening mechanism 14 and plugs into the electrical outlet provided for the garage door opening mechanism 14. One or more mounting screws (not shown) pass through eyelets in the casing 46 to attach the casing to the garage ceiling 51. Additionally, in one embodiment, the garage monitoring system 40 further contains an electrical outlet 53 on the side thereof so that an electrical cord 54 for the garage door opening mechanism 14 can be plugged into the garage monitoring system 40.

The CO detector 42 utilized in the illustrated embodiment can be in itself of conventional design. As the operation of CO detectors are well known, a detailed description of the CO detector 42 need not be provided herein. One skilled in the art will recognize that the CO detector 42 used in the garage monitoring system 40 can be any available CO detector, such as, for example, carbon monoxide detector model number FCD2 marketed under the First Alert® brand name and available from BRK Brands, Inc. of Aurora, Ill. In the embodiment illustrated in FIG. 2, the CO detector 42 in the garage monitoring system 40 is a mechanically separate unit that is plugged into the monitoring mechanism 44 so that the CO detector receives its electrical power from the monitoring mechanism. The monitoring mechanism 44 is installed and used with the CO detector 42 by plugging the CO detector into an appropriate female electrical outlet (not shown) provided on the front of the casing 46 of the monitoring mechanism 44. Alternately, the CO detector 42 can be mounted adjacent the signal generating apparatus 44 and can receive its power through an independent electrical cord (not shown), or the CO detector can be battery operated, without departing from the scope of the invention. In yet another embodiment, the CO detector 42 can be made integral with monitoring mechanism 44 so that the monitoring mechanism and CO detector have a common casing 46 and are purchased and installed as a single unit. The CO detector 42 is preferably calibrated relatively low (200–400 ppm) so as to detect the presence of carbon monoxide before any occupants of the garage or other building are aware of it. Alternately, the CO detector 42 can be calibrated with a time sensitive threshold. For example, the detector 42 can be calibrated to respond when the concentration of carbon monoxide in the air is 50 ppm for six hours, 200 ppm for one-half hour or 400 ppm at any time. However, these specific calibration limits are for example purposes only, and not intended to be limiting.

Figure 3B:
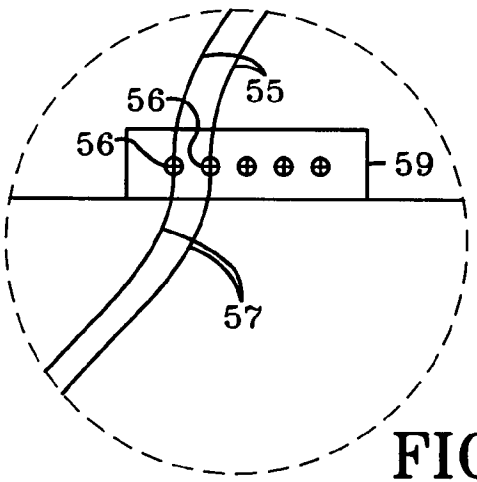
FIG. 3B is an enlarged portion of FIG. 3A.

When installed, it is desirable that the garage monitoring system 40 be placed next to the garage door opening mechanism 14. Signal wires 55 from the monitoring mechanism 44 are connected to the garage door opening mechanism 14. As illustrated in FIG. 3B, the signal wires 55 are attached to the same posts 56 on a terminal strip 59 of the garage door opening mechanism 14 that wires 57 connecting the wall switch 36 to the garage door opening mechanism are connected to. The wires 55 are fastened to the posts 56 with eyelets (not shown) or connected by any other means consistent with sound engineering judgment such as with quick connect wire crimps.

With this system 40, when the CO detector 42 senses the presence of carbon monoxide in the event the carbon monoxide concentration reaches an unsafe level, the CO detector 42 will sound an audible alarm. The CO monitoring mechanism 44 responds to the alarm produced by the CO detector 42 that, if the door is closed, will generate a signal that will cause the garage door opening mechanism 14 to automatically open the garage door 12. Desirably, the system 40 includes a lockout control so that once the garage door 12 is opened by means of the detector 42 sensing a high level of carbon monoxide, the garage door 12 cannot be closed by means of the garage door opener switch 36 or the remote control transmitter (not shown). Thus, if an automobile is allowed to run inside a closed garage, the garage door 12 will open when the detector 42 senses a high level of carbon monoxide and it cannot be closed until a predetermined time period after the CO detector's alarm stops sounding. This will prevent the garage door 12 from being closed prematurely, before the carbon monoxide has been dissipated, particularly by use of a remote control transmitter.

Figure 4:
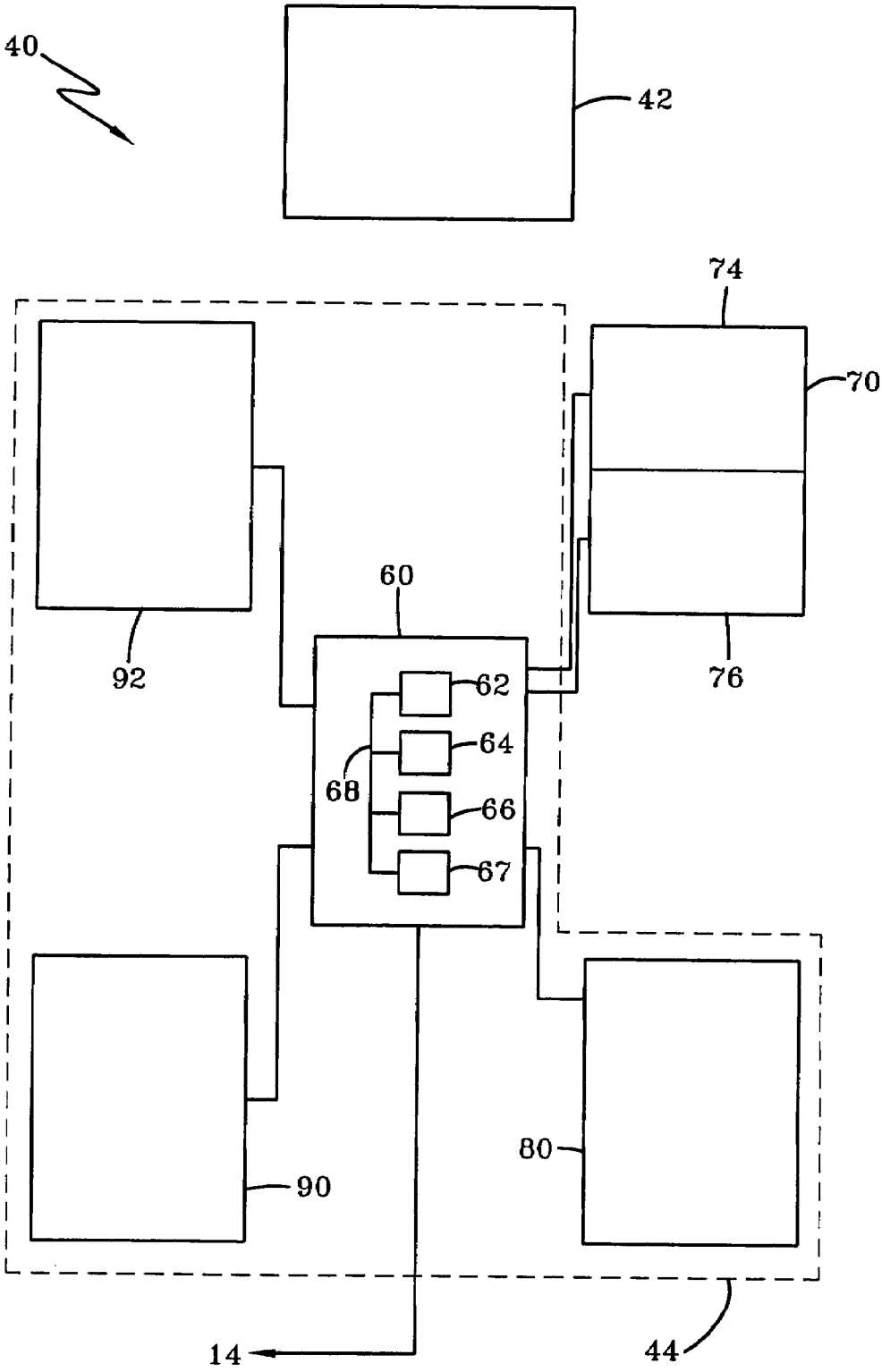
FIG. 4 is a block diagram of the garage monitoring system of FIG. 1.

FIG. 4 is a functional block diagram of the garage monitoring system 40 according to one embodiment of the invention. The monitoring mechanism 44 contains a conventional microprocessor unit 60 for executing a program corresponding to flowcharts shown in FIGS. 5 and 6 and described below. The microprocessor 60 includes a CPU (Central Processing Unit) 62, a ROM (Read Only Memory) 64, a RAM (Random Access Memory) 66, a timer 67, and an I/O port 68. The processor 60 receives input signals and controls output signals to a garage door position sensor 70, an acoustic sensor 80, a temperature sensor 90, a heater 92, the garage door lockout control and the garage door opening mechanism 14 and as will be described below to generate commands to open the garage door 12 in response to high levels of carbon monoxide in the garage.

The garage door position sensor 70 detects when the garage door 12 is not in the open position. Desirably, the garage door position sensor 70 is a distance measuring unit that uses ultrasonic waves to detect the distance to a nearest point of an object (hereinafter, also call an obstacle) present in specific direction in relation to the sensor 70. As illustrated in FIG. 3, the garage door position sensor 70 is attached to the ceiling 51 of the garage above the top panel segment 16 of the open garage door 12. Preferably, the garage door position sensor 70 is positioned a distance D between about 12 inches (30 cm) and about 36 inches (91 cm) from a top edge 72 of the top panel segment 16 of the garage door 12, and more desirably about 24 inches (61 cm) from the top edge 72. The garage door position sensor 72 is configured to determine if an obstacle is present in the location where the garage door 12 should be when the garage door is in the open position. Thus, the garage monitoring system 40 will open the garage door 12 in response to a carbon monoxide alarm if the garage door is closed, but not inadvertently shut the garage door 12 if the garage door is already in the open position, which could further aggravate the problem.

As illustrated in FIG. 4, the position sensor 70 includes an ultrasonic transmitter 74 and an ultrasonic receiver 76 electrically connected to the processor 60. The transmitter 74 and receiver 76 of the position sensor 70 probe for objects and measure the distance to the object with ultrasonic pulse signals by detecting the ultrasonic echo from the object. The transmitter 74 sends a pulse in the direction of the open garage door 12. The receiver 76 identifies the echo of the pulse and the time it takes for the pulse to travel the distance from the transmitter 74 to the obstacle and back to the receiver 76 is measured. The processor 60 uses this time to calculate the distance to the obstacle to determine if the obstacle is the garage door 12 in the open position. The ultrasound transmitter 74 and receiver 76 can be of any convention design known to one skilled in the art and need not be described in additional detail. One example of a suitable ultrasound transmitter 74 is Panasonic® model no. EFR-RTQB40KS available from Matsushita Electric Industrial Co., Ltd. of Osaka, JP. A suitable ultrasound receiver 76 is Panasonic® model no. EFR-RQB40K5 available from Matsushita Electric Industrial Co., Ltd. of Osaka, JP.

Referring back to FIGS. 2 and 3, as the height H of the ceiling 51 above the top panel segment 16 of the open garage door 12 may vary from garage to garage, a calibration switch 78 is provided to manually adjust the window of time the echo is expected to reach the receiver 76. This can be done by mounting the position sensor 70 to the ceiling 51 of the garage in an appropriate place over the opened garage door 12. Then with the garage door 12 in the open position, the transmitter 74 sends a pulse in the direction of the upper panel segment 16 of the garage door 12 and displays the a number corresponding to the distance on a seven segment display or by chirping out the distance with an internal sounder. The calibration switch 78 is set to this number. Proper calibration of the position sensor 70 can be indicated by a garage door position LED 79 on the casing 46 (See FIG. 2) indicating that the position sensor is detecting the opened garage door 12.

In operation, the transmitter 74 aims the pulse in the direction of where the garage door 12 would be when it is in the open position. If the garage door 12 is in fact in the open position, the pulse will bounce off the surface of the garage door 12 and the echo will be detected by the receiver 76. If the garage door 12 is not in the open position, the pulse will continue traveling until it reaches some other object, such as the top of a car (not shown) or the garage floor (not shown). When the pulse reaches the other object, it will similarly bounce off the object and return to the receiver 76. Desirably, the receiver 76 listens for the echo of the pulse until the echo is received or a maximum timer value is reached. When the echo is received, the time required to receive the echo as measured by the timer 67 is compared to the calibrated time selected with the calibration switch 78. If the maximum timer value is reached, the maximum timer value is compared to the calibration setting. If the time required to receive the echo is within an appropriate window, indicating that there is an object in the location where the garage door 12 should be located when in the open position, a door opened indicator signal is set by the processor 60 to illuminate the LED 79. If the actual time required to receive the echo is not within the selected window, indicating that there is not an object in the location where the garage door 12 would be located when in the open position, a door not opened indicator signal is set by the processor 60. Desirably, the door position LED 79 is a bi-colored LED such that the status of the garage door can be indicated on the LED 79 such as by having the door opened indicator signal cause the door position LED 79 to be one color such as green, and the door not opened indicator signal causing the door position LED 79 to be a second color, such as amber.

Desirably, the monitoring mechanism 44 is responsive to an audible horn 81 of the CO detector 42. In the illustrated embodiment, the acoustic sensor 80 is included in the monitoring mechanism 44 as a sound sensor for sensing the audible alarm 81 of the CO detector 42. The acoustic sensor 80 may be any small, relatively sensitive, preferably omni-directional, microphone. For example, the acoustic sensor 80 may be an electret microphone. One suitable example of an electret microphone for use in the acoustic sensor 80 is Panasonic® model no. WM-54BT available from Matsushita Electric Industrial Co., Ltd. of Osaka, JP. Typically, CO detectors 42 produce a tone at about 3.2 kHz and about 80 decibels or higher. The electrical signal produced by the acoustic detector 80 is supplied to the processor 60. To be effective, the processor 60 should recognize the horn 81 of the CO detector 42 but discriminate other sounds. In one embodiment, this result is achieved by integrating the electrical signals produced by the acoustic sensor 80 louder than a certain magnitude over time. Sounds of either insufficient duration or insufficient magnitude fail to integrate to a threshold established in the processor 60 and, therefore, fail to cause the processor 60 to generate a signal to open the garage door 12. On the other hand, when the alarm signal continues for sufficient duration at a sufficient magnitude, then the threshold is exceeded so that a signal is generated by the processor 60 to open the garage door 12. For example, a threshold may be set to include sounds of 75 decibels that last for at least one minute. This selective discrimination is important to prevent identification of car horns, loud music or other loud sounds as an alarm of the CO detector 42. The acoustic sensor 80 may also include a frequency-sensitive amplifier so that the sound of the CO detector 42 alarm is amplified selectively, i.e., electrical signals produced in the frequency generated by the horn 81 of the CO detector 42 are amplified and signals not corresponding to the alarm signal are not amplified or are amplified much less than the signal produced in response to the CO detector 42. In one optional embodiment, the acoustic sensor 80 is mounted within a resonant chamber within the casing 46 designed to resonating at or near the frequency of the audible CO detector 42 alarm.

The heater 92 is situated within the monitoring mechanism 44 so as to be positioned adjacent to the CO detector 42 when it is plugged into the casing 46. CO detectors 42 function more reliably at temperatures above a certain minimum operational temperature. As many garages are not heated, the heater 92 maintains the CO detector 42 above this minimum operational temperature. In one embodiment, the heater 92 is a resistive type heater electrically connected to the AC power supply grid through the electrical plug 50 of the monitoring mechanism 44 and controlled by the processor 60. The processor 60 receives a temperature input from the temperature sensor 90. As is known, the temperature sensor 90 can be an integration circuit having an output voltage proportional to the temperature. The processor 60 contains an analog to digital converter to convert the output voltage of the temperature sensor 90 to a digital number representing the measured temperature. If the temperature measured by the temperature sensor 90 drops below a preset threshold temperature, for example 40° F. (4.4° C.), the processor 60 causes the heater to turn on. When the measured temperature rises above another temperature, for example 50° F. (10° C.), the processor 60 turns off the heater 92. Heaters 92 and temperature sensors 90 are well known in the art and need not be discussed in further detail. The heater 92 is positioned within the casing 46 adjacent to the CO detector 42 with the portion of the casing between the heater 92 and the CO detector 42 being made of metal or other suitable heat conducting material.

Figure 5:
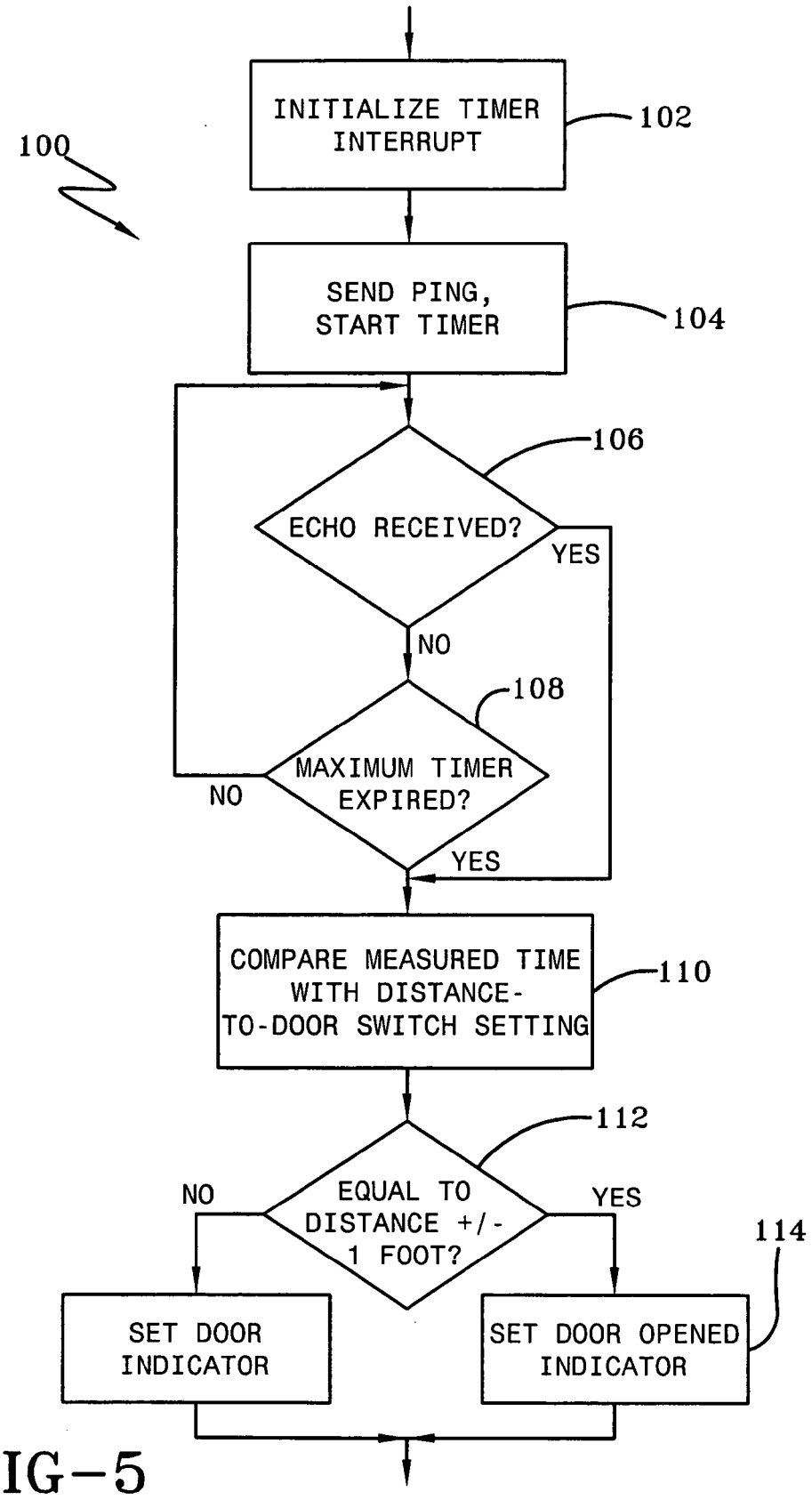
FIG. 5 is an operation flowchart representing a procedure executed by the garage monitoring system to generate the garage door position signal.

FIG. 5 illustrates an operation flowchart of a method 100 executed by the garage door position sensor 70 and the monitoring mechanism 44 to generate a garage door position signal. In step 102, the timer 67 is initialized. In step 104, the transmitter 74 transmits a pulse and the timer 67 is started. As set forth above, the transmitter 74 aims the pulse in the direction of the garage door 12 when in the open position. If the garage door 12 is indeed open, the pulse will bounce off the surface of the garage door 12 and return to the receiver 76. If the garage door 12 is not in the open position, the pulse will continue traveling until it reaches some other object, such as the top of a car or the garage floor and similarly bounce off the object and return to the receiver 76. As indicated in step 106, the receiver 76 listens for the echo of the pulse. The receiver 76 continues to listen until the echo is received or a maximum timer value is reached as indicated at step 108. When the echo is received, the time required to receive the echo as measured by the timer is recorded. This time is then compared to the calibration setting selected by the calibration switch in step 110. If the maximum timer value is reached, the maximum timer value is compared to the calibration setting. If the actual time required to receive the echo is within an appropriate window, indicating that there is an object in the location where the garage door 12 is located when in the open position at step 112, a door opened indicator signal is set as indicated in block 114. If the actual time required to receive the echo is not within the selected window, indicating that there is not an object in the location where the garage door would be located when in the open position, a door not opened indicator signal is set as indicated in block 116. The status of the garage door can be indicated on the door position LED 79 such as by having the door opened indicator cause the door position LED to be green or the door not opened indicator causing the door position LED to be amber.

Figure 6:
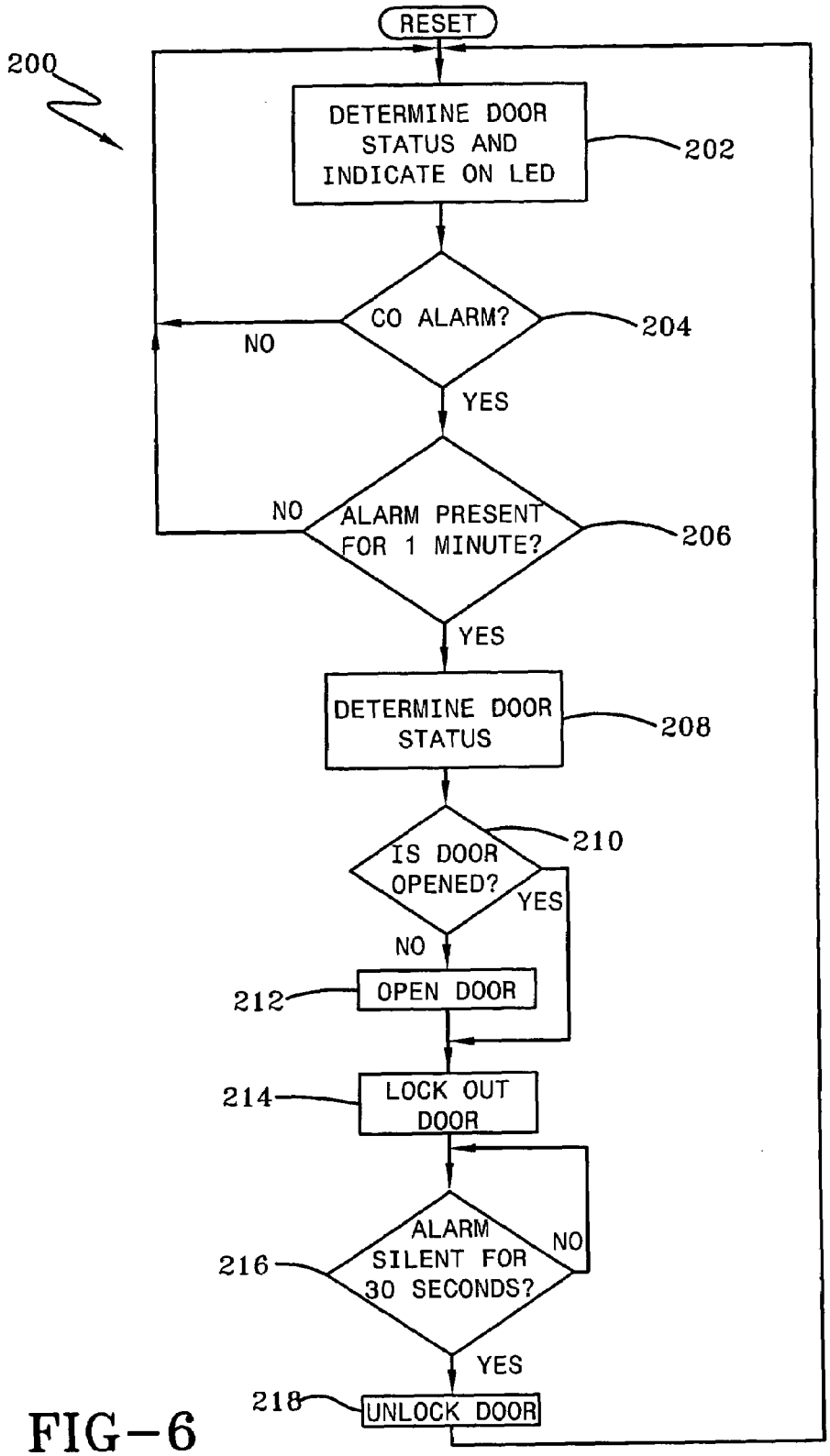
FIG. 6 is an operational flowchart representing a procedure executed by the garage monitoring system to generate a signal to automatically open the garage door in the event of a high carbon monoxide condition.

A method 200 of opening the garage door in response to a high CO alarm is indicated in the flowchart illustrated in FIG. 6. In step 202, the position of the garage door is determined, such as by the method 100 of FIG. 5 and the current door status is indicated on the door position LED 79. In step 204, the presence of a high CO alarm is detected. If there is a high CO alarm, the timer 67 measures if the alarm is present for a desired duration to filter out spurious alarms and ambient noise as indicated at step 206. In step 208, the position of the garage door is again determined by the method 100. At step 210, if the door is not opened, then the opening mechanism 14 opens the garage door at step 212. After the garage door 12 is opened, the garage door is locked out in step 214 to prevent the door from being closed while the high carbon monoxide condition exists. If the garage door 12 was already in the open position, the door is locked out to prevent the garage door from shutting. In step 216, the alarm is monitored until the alarm is no longer alarming for a determined period of time. For example, the timer 67 counts until the alarm is silent for a predetermined period, such as 30 seconds. In the next step 218, the garage door is unlocked after the alarm has been silent for the predetermined period of time.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. A garage monitoring system for use with an automatic garage door opening mechanism configured to move a garage door between an open and a closed position, the garage monitoring system comprising:

a carbon monoxide detector configured to sense the presence of carbon monoxide within the garage and generate an audible alarm when carbon monoxide reaches a predetermined level in the garage;

a heater positioned adjacent the carbon monoxide detector for maintaining the carbon monoxide detector above a minimum operational temperature;

a garage door position sensor for determining the position of the garage door; and a monitoring mechanism interfacing with the garage door opening mechanism, the monitoring system comprising an acoustic detector for sensing audible sounds, including an audible alarm from the carbon monoxide detector, and for generating a signal to the garage door opening mechanism to open the garage door when the carbon monoxide detector generates an alarm and the garage door position sensor indicates that the garage door is not in an open position.

2. The garage monitoring system of claim 1, wherein the garage monitoring system comprises a casing for the monitoring mechanism and the carbon monoxide detector plugs into said casing.

3. The garage monitoring system of claim 1, wherein the garage door position sensor is a distance measuring unit that uses ultrasonic waves to detect the distance to a nearest point of an object.

4. The garage monitoring system of claim 3, wherein the garage door position sensor comprises an ultrasonic transmitter and an ultrasonic receiver.

5. The garage monitoring system of claim 1, wherein the garage door position sensor is attached above the open garage door a distance between about 12 inches (30 cm) and about 36 inches (91 cm) from a top edge of the of the garage door.

6. The garage monitoring system of claim 1, wherein the garage monitoring system is configured to open the garage door in response to a carbon monoxide alarm when the garage door is not in the open position but not shut the garage door if the garage door is in the open position.

7. The garage monitoring system of claim 1, wherein the garage monitoring system contains a calibration switch to calibrate the height of the garage door position sensor above the open garage door.

8. The garage monitoring system of claim 1, wherein the garage monitoring system interfaces with the garage door opening mechanism with wires to transmit a signal to open the garage door.

9. The garage monitoring system of claim 1, wherein the acoustic detector is an electret microphone.

10. The garage monitoring system of claim 1, wherein monitoring mechanism integrates electric signals produced by the acoustic detector greater than a determined magnitude over a determined time.

11. The garage monitoring system of claim 1, further comprising a temperature sensor configured to measure the temperature in the vicinity of the carbon monoxide detector.

12. A garage monitoring system for use with an automatic garage door opening mechanism configured to move a garage door between an open and a closed position, the garage monitoring system comprising:

a carbon monoxide detector configured to sense the presence of carbon monoxide within the garage;

a garage door position sensor comprising an ultrasonic transmitter and an ultrasonic receiver for measuring the distance to an object using ultrasonic waves for determining the position of the garage door; and a monitoring mechanism interfacing with the garage door opening mechanism, the monitoring system generating a signal to the garage door opening mechanism to open the garage door when the carbon monoxide detector generates an alarm and the garage door position sensor indicates that the garage door is not in an open position.

13. The garage monitoring system of claim 12, wherein the carbon monoxide detector generates an audible alarm when carbon monoxide reaches a predetermined level in the garage and the monitoring mechanism comprises an acoustic detector for sensing audible sounds, including an audible alarm from the carbon monoxide detector.

14. The garage monitoring system of claim 12, wherein the garage door position sensor is attached above the open garage door a distance between about 12 inches (30 cm) and about 36 inches (91 cm) from a top edge of the of the garage door.

15. The garage monitoring system of claim 12, further comprising a temperature sensor configured to measure the temperature in the vicinity of the carbon monoxide detector and a heater positioned adjacent the carbon monoxide detector for maintaining the carbon monoxide detector above a minimum operational temperature.

16. A garage monitoring system for use with an automatic garage door opening mechanism configured to move a garage door between an open and a closed position, and a carbon monoxide detector configured to sense the presence of carbon monoxide within the garage and generate an audible alarm when carbon monoxide reaches a predetermined level in the garage, the garage monitoring system comprising:

a garage door position sensor for determining the position of the garage door; and a monitoring mechanism interfacing with the garage door opening mechanism, the monitoring system comprising an acoustic microphone for sensing audible sounds, including an audible alarm from the carbon monoxide detector, wherein monitoring mechanism integrates electric signals from the microphone greater than a determined magnitude over a determined time to generate a signal to the garage door opening mechanism to open the garage door when the garage door position sensor indicates that the garage door is not in an open position.

17. The garage monitoring system of claim 16, wherein the garage door position sensor comprises an ultrasonic transmitter and an ultrasonic receiver for measuring the distance to an object using ultrasonic waves for determining the position of the garage door.

18. The garage monitoring system of claim 17, wherein the garage door position sensor is attached above the open garage door a distance between about 12 inches (30 cm) and about 36 inches (91 cm) from a top edge of the of the garage door.

19. The garage monitoring system of claim 16, wherein the garage monitoring system interfaces with the garage door opening mechanism with wires to transmit a signal to open the garage door.

20. The garage monitoring system of claim 16, further comprising a temperature sensor configured to measure the temperature in the vicinity of the carbon monoxide detector and a heater positioned adjacent the carbon monoxide detector for maintaining the carbon monoxide detector above a minimum operational temperature.

* * * * *